US009052735B2

(12) United States Patent
Min et al.

(10) Patent No.: US 9,052,735 B2
(45) Date of Patent: Jun. 9, 2015

(54) ACTIVE CONTROL METHOD OF ACCELERATOR PEDAL EFFORT

(71) Applicants: Hyundai Motor Company, Seoul (KR); Kia Motors Corporation, Seoul (KR)

(72) Inventors: Jeong Seon Min, Gwangju (KR); Eun Sik Kim, Gyeonggi-Do (KR); Yang Rae Cho, Gyeonggi-Do (KR); Ho Seung Jang, Uiseong-Gun (JP)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 55 days.

(21) Appl. No.: 13/829,966

(22) Filed: Mar. 14, 2013

(65) Prior Publication Data

US 2014/0142806 A1 May 22, 2014

(30) Foreign Application Priority Data

Nov. 21, 2012 (KR) ..... 10-2012-0132139

(51) Int. Cl.
*G05G 1/30* (2008.04)
*G05G 1/40* (2008.04)
*G05G 5/03* (2008.04)

(52) U.S. Cl.
CPC .. *G05G 5/03* (2013.01); *G05G 1/30* (2013.01); *G05G 1/40* (2013.01)

(58) Field of Classification Search
CPC ..... B60L 2250/26
See application file for complete search history.

(56) References Cited

U.S. PATENT DOCUMENTS

| | | | | |
|---|---|---|---|---|
| 6,945,103 | B1 * | 9/2005 | Lee et al. | 73/146.5 |
| 8,235,865 | B2 * | 8/2012 | Leibbrandt et al. | 477/94 |
| 2005/0033517 | A1 * | 2/2005 | Kondoh et al. | 701/301 |
| 2005/0247538 | A1 * | 11/2005 | Dobele et al. | 192/105 B |
| 2007/0272187 | A1 * | 11/2007 | Celisse et al. | 123/179.4 |
| 2011/0184615 | A1 * | 7/2011 | Marcus | 701/58 |
| 2012/0143439 | A1 * | 6/2012 | Kim et al. | 701/36 |
| 2012/0143441 | A1 * | 6/2012 | Yamazaki et al. | 701/36 |
| 2012/0221220 | A1 * | 8/2012 | Yamazaki et al. | 701/70 |
| 2012/0330544 | A1 * | 12/2012 | Joong et al. | 701/408 |
| 2013/0049942 | A1 * | 2/2013 | Kim et al. | 340/438 |

FOREIGN PATENT DOCUMENTS

| | | | |
|---|---|---|---|
| KR | 20-1999-0029078 | U | 7/1999 |
| KR | 10-2010-0063453 | A | 6/2010 |
| KR | 10-2010-0064786 | A | 6/2010 |
| KR | 20100063453 | A | 6/2010 |
| KR | 10-2011-0062017 | A | 6/2011 |
| KR | 10-2011-0092098 | A | 8/2011 |
| KR | 10-2011-0118215 | A | 10/2011 |

* cited by examiner

*Primary Examiner* — James Trammell
*Assistant Examiner* — Demetra Smith-Stewart
(74) *Attorney, Agent, or Firm* — Mintz Levin Cohn Ferris Glovsky and Popeo, P.C.; Peter F. Corless

(57) ABSTRACT

An active control system and method for an accelerator pedal effort is disclosed, in which the pedal effort of the accelerator pedal is varied actively in accordance with a driving mode and a parking mode of a vehicle.

10 Claims, 6 Drawing Sheets

ACTIVE CONTROL METHOD OF ACCELERATOR PEDAL EFFORT

CROSS-REFERENCE TO RELATED APPLICATION

This application claims under 35 U.S.C. §119(a) the benefit of Korean Patent Application No. 10-2012-0132139 filed Nov. 21, 2012 the entire contents of which are incorporated herein by reference.

BACKGROUND (a) Technical Field

The present disclosure relates to an active control method and system for controlling an accelerator pedal effort, and more particularly, to an active control method for controlling an accelerator pedal effort through which the accelerator pedal effort can be varied actively in an accelerator pedal apparatus provided with a pedal effort adjusting module in accordance with a driving mode and a parking mode.

(b) Background Art

FIG. 1 is a perspective view illustrating an accelerator pedal apparatus for a vehicle which has an organ type assembly which includes a pedal arm housing 1 that is fixed to a vehicle body panel at a lower part of a driver seat, a pedal arm 2 one end of which is coupled rotatably to the pedal arm housing 1, a pedal bracket 3 that is fixed to a floor panel at a lower part of the driver seat, and a pedal pad 4 one end of which is hinge-coupled rotatably to the pedal bracket 3 and which is ball-jointed to the pedal arm 2. Here, a spring plate 5 is coupled to one end of the pedal arm 2 disposed inside the pedal arm housing 1 and one end of a spring 6 is supported on the spring plate 5 and the other end of the spring 6 is supported on the pedal arm housing 1.

Accordingly, in the accelerator pedal apparatus shown in FIG. 1, the spring 6 is compressed elastically to provide pedal effort to the pedal pad 4 when the pedal arm 2 rotates with respect to the pedal arm housing 1 through a hinge shaft 7. However, in this accelerator pedal apparatus, since the spring 6 is preset in advance with an elastic coefficient to meet safety regulations prescribed based on each countries specific regulations, the pedal effort cannot be adjusted unless the spring is replaced with new one. Currently, there is no way to vary actively the accelerator pedal effort in based on a driving mode and a parking mode and thus there is a great need for this in the industry.

Furthermore, it should be noted that the description provided above is merely for aiding in understanding of the background of the present invention and should not be construed as admitted prior art.

SUMMARY OF THE DISCLOSURE

The present invention has been made in an effort to solve the above-described problems associated with prior art and provides an active control method and system for controlling an accelerator pedal effort through which a driving mode and a parking mode are classified in an accelerator pedal apparatus provided with an effort adjusting function through a shifting stage and a vehicle velocity of a vehicle. As a result, the pedal effort of the accelerator pedal in the exemplary embodiment of the present invention can be varied actively in accordance with the driving mode and the parking mode.

In order to achieve the above objects of the present invention, the present invention provides an active control system and method for controlling an accelerator pedal effort. In particular, a processor within a controller may be configured to determine whether a vehicle is in a driving mode or a parking mode via shifting stage input signals and the vehicle velocity when the vehicle is turned on. The processor may then be configured to increase the current pedal effort of the accelerator pedal to a preset pedal effort when the vehicle is determined to be in a parking mode; and a processor is also configured to decrease the current pedal effort of the accelerator pedal to the preset pedal effort when the vehicle is determined to be in the driving mode.

Further, the active control method and system of the present invention may further include a system determining step to determine, via the processor on the controller, whether a pedal effort adjusting system is in a normal state when the vehicle turns on prior to determining which mode the vehicle. Furthermore, the processor may be configured so that the mode is determined only when the pedal effort adjusting system is in a normal state during the system determining step and when the pedal effort adjusting system is determined to be in an abnormal state, the current pedal effort of the accelerator pedal is maintained as being in an initial pedal effort state.

The pedal effort adjusting system is determined as being in the normal state only when all of the conditions are satisfied that a voltage signal of a battery is a normal, there is no request signal for initializing it in accordance with an emergency state and an active adjusting mode signal of pedal effort is generated. Additionally, determining the mode further includes determining that the vehicle is in the parking mode only when all of the conditions are satisfied that the shifting stage input signal is in a R (reverse) stage, the maintaining time of the R stage exceeds a predetermined time or more and the vehicle velocity is a predetermined velocity or less. Furthermore, the processor may be configured to determine that the vehicle is in a driving mode only when the shifting stage input signals are rest shifting stages other than the R stage, and simultaneously the vehicle velocity is a predetermined velocity or more.

In addition, in some exemplary embodiments of the present invention, the pedal effort may be decreased by decreasing the pedal effort to maintain the pedal effort prior to increasing pedal effort.

Also, in other exemplary embodiments of the present invention, the vehicle may be determined as being in the parking mode only when the shifting stage input signal is in a R (reverse) stage, the R stage has been maintained for 0.5-1.0 sec or more and the vehicle velocity is 15-20 km/h or less. Likewise, the vehicle may be determined to be in a driving mode only when the shifting stage input signals are rest shifting stages other than for the R stage, and simultaneously the vehicle velocity is 15-20 km/h or more.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
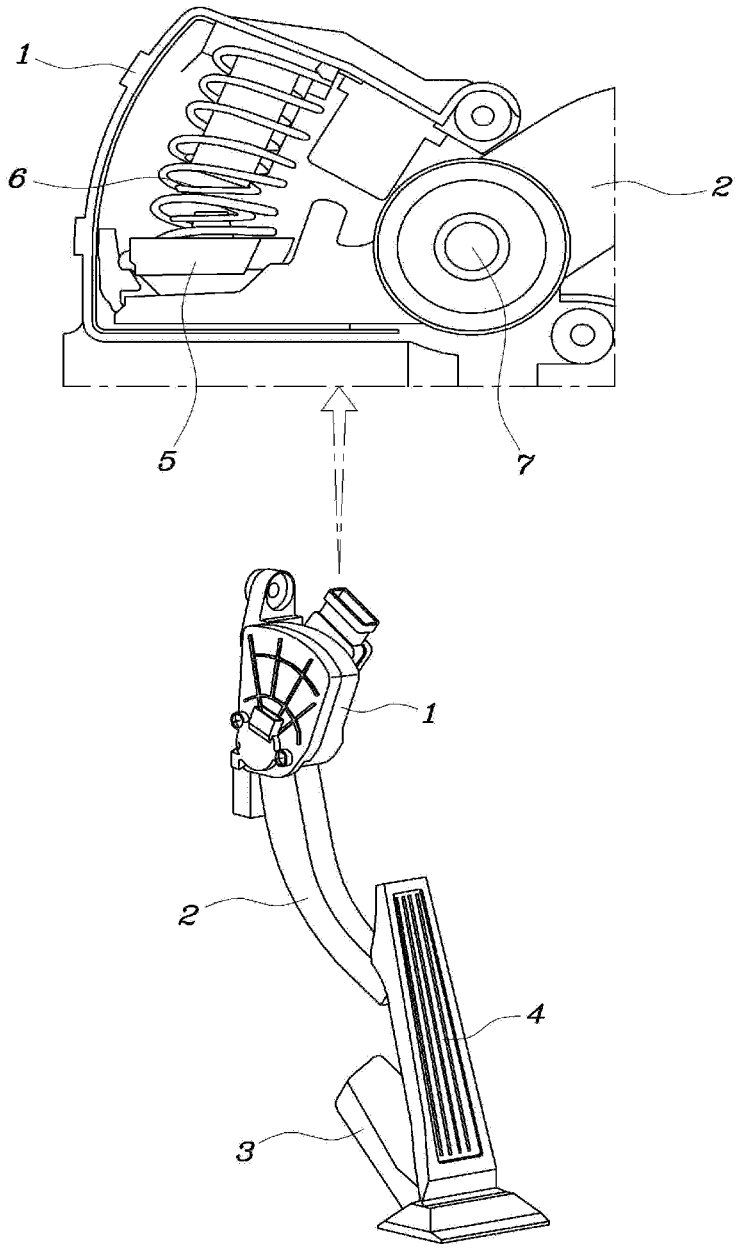
FIG. 1 PRIOR ART
FIG. 1 is a perspective view illustrating a conventional accelerator pedal apparatus not provided with a pedal effort adjusting.
Figure 2:
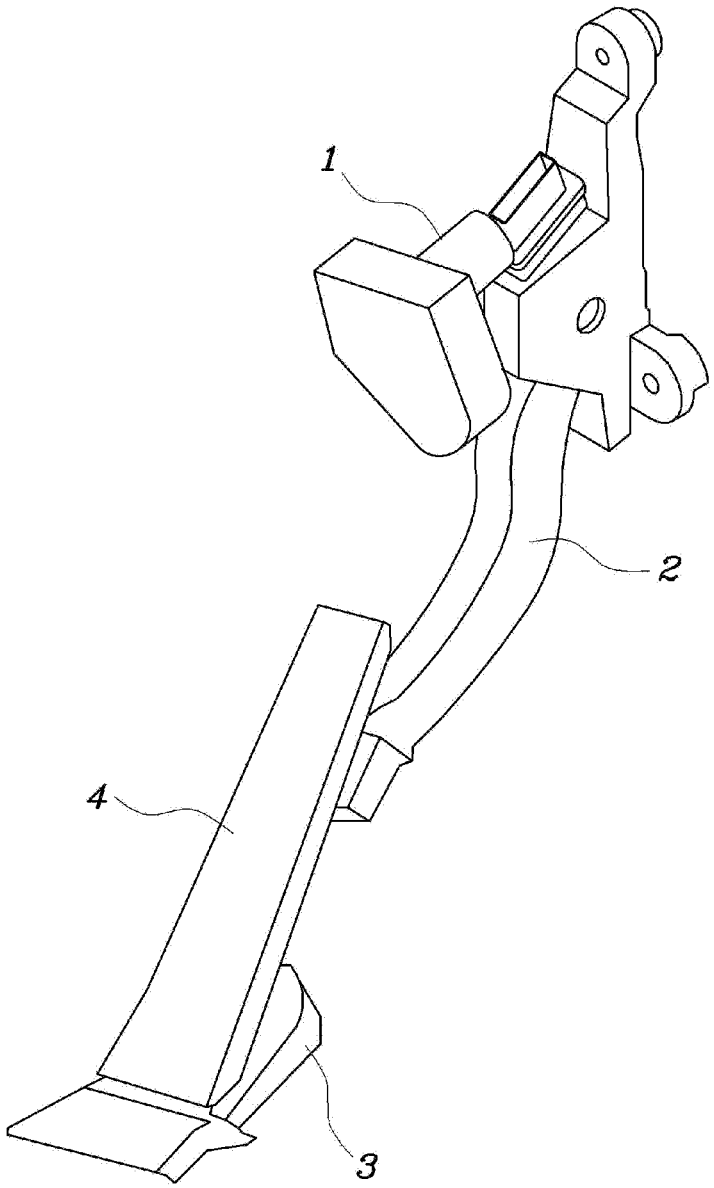
FIGS. 2 to 5 are views illustrating an accelerator pedal apparatus provided with a pedal effort adjusting function according to the exemplary embodiment of the present invention, respectively.

It should be understood that the appended drawings are not necessarily to scale, presenting a somewhat simplified representation of various preferred features illustrative of the basic principles of the invention.

In the figures, reference numbers refer to the same or equivalent parts of the present invention throughout the several figures of the drawing.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Furthermore, the control logic of the present invention may be embodied as non-transitory computer readable media on a computer readable medium containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinafter, preferred embodiments of the present invention will be described referring to the accompanying drawings.

The accelerator pedal apparatus for a vehicle provided with a pedal effort adjusting module according to the present invention, as shown in FIGS. 2 to 5, may include a pedal arm housing 1 that is fixed to a vehicle body panel in a floor board in front of a driver seat, a pedal arm 2 one end of which is coupled rotatably to the pedal arm housing 1, a pedal bracket 3 that is fixed to a floor panel in front of the driver seat, and a pedal pad 4 one end of which is hinge-coupled rotatably to the pedal bracket 3 and which is ball-jointed to the pedal arm 2. Meanwhile, a spring plate 5 is coupled to one end of the pedal arm 2 disposed inside the pedal arm housing 1 and the pedal arm 2 rotates with respect to the pedal arm housing 1 through a hinge shaft 7.

The accelerator pedal apparatus according to the present invention may be provided with a pedal effort adjusting module 10 wherein the pedal effort adjusting module may include: a spring 11 one end of which is supported on one end of the pedal arm 2 disposed inside the pedal arm housing 1; a spring fixing block 12 that is arranged to support the other end of the spring 11; a motor 13 that is fixed to the pedal arm housing 1; and a power transmission mechanism 14 that transmits power from the motor 13 to the spring fixing block 12 and moves the spring fixing block 12 for a length of the spring 11 to be varied.

Figure 3:
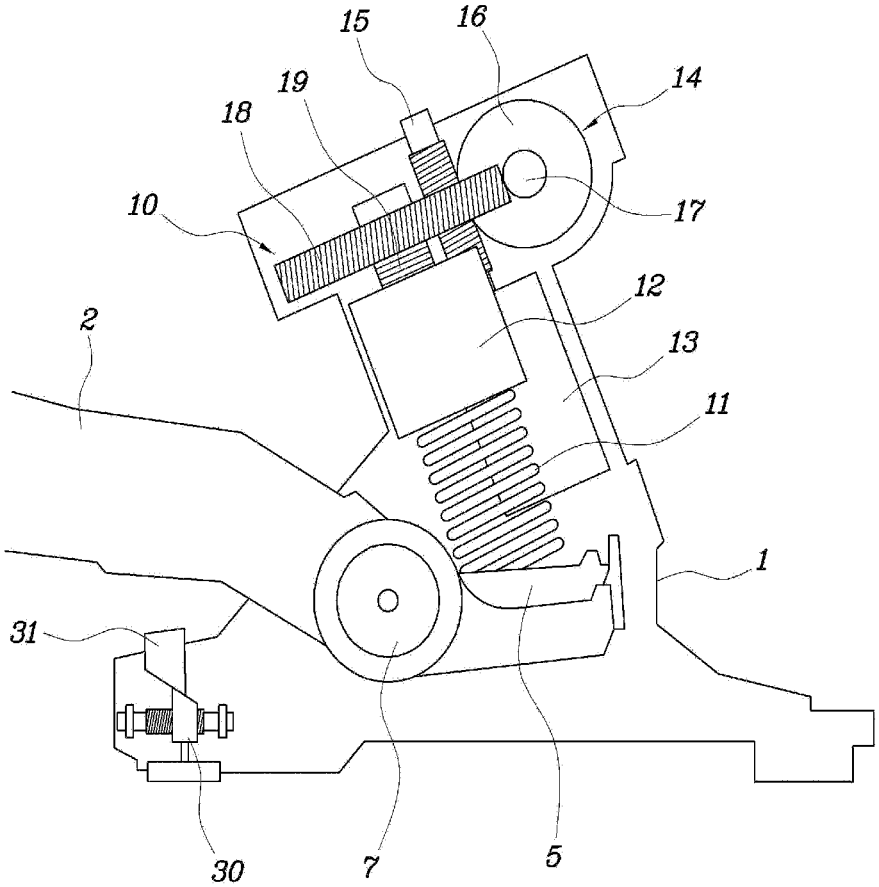
Figure 4:
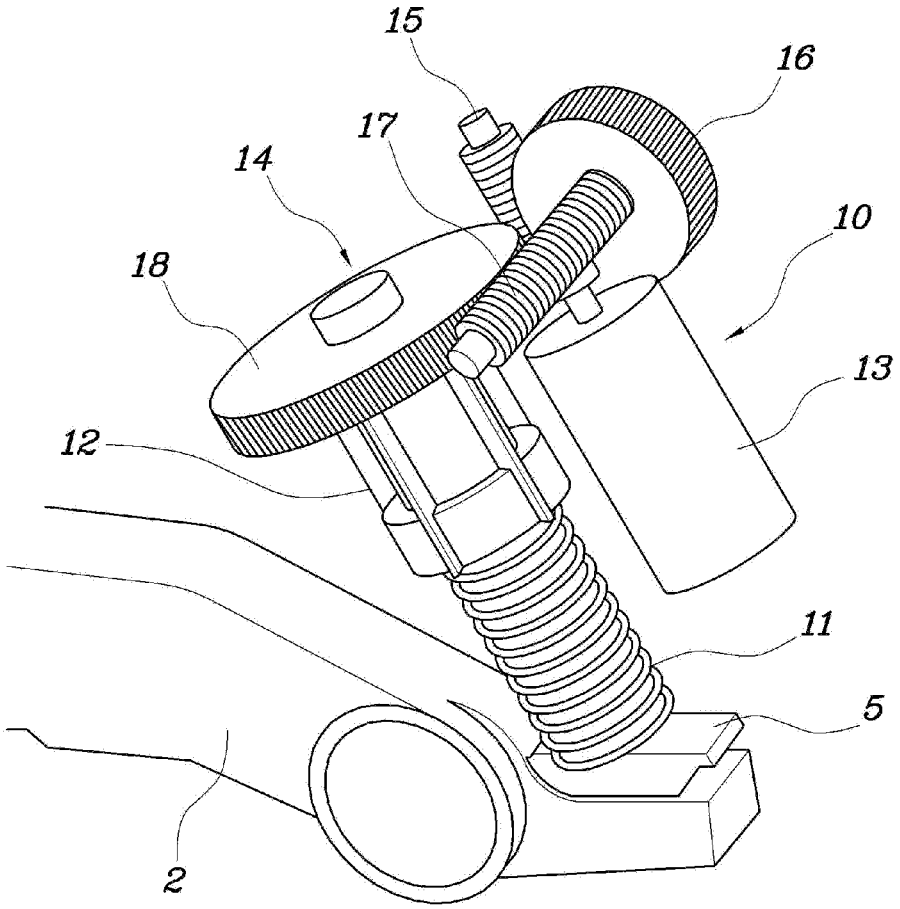
Figure 5:
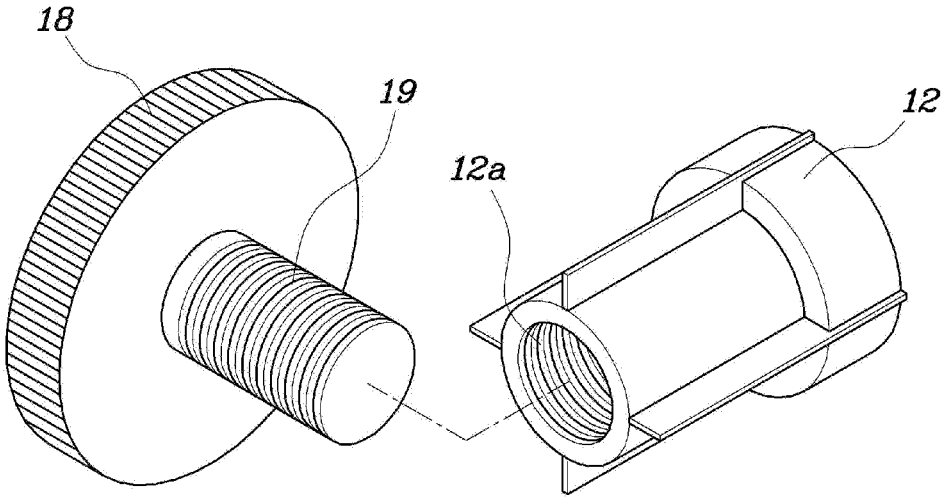

Here, the spring 11 may be arranged to be supported directly on one end of the pedal arm 2, or as shown in FIGS. 3 and 4, it may be arranged so that the spring plate 5 is coupled to one end of the pedal arm 2 disposed inside the pedal arm housing 1 and a lower end of the spring 11 is supported on the spring plate 5. Accordingly, when the pedal arm 2 rotates around the hinge shaft 7, the spring 11 may be compressed elastically between the spring plate 5 and the spring fixing block 12 and a pedal effort may be provided to the pedal pad 4 through the pedal arm 2 during the elastic compression of the spring.

The power transmission mechanism 14 may be arranged to couple the motor 13 and the spring fixing block 12 to transmit power from the motor 13 to the spring fixing block 12. Additionally, it may include a first worm gear 15 coupled integrally to a shaft of the motor 13, a first worm wheel gear 16 that is meshed with the first worm gear 15 to be rotated, a second worm gear 17 coupled integrally to a center of the first worm wheel gear 16, a second worm wheel gear that is meshed with the second worm gear 17 to be rotated, and a gear ball 19 which protrudes integrally from a center of the second worm wheel gear 16 and on an outer peripheral surface of which a plurality of screw grooves are formed.

Furthermore, a plurality of coupling grooves 12*a* processed with screw grooves may be formed on an inner peripheral surface of the spring fixing block 12, into which a gear bolt 19 is screw-fastened. When the second worm wheel gear 18 rotates, the spring fixing block 12 is moved linearly along the gear bolt 19 so that a length of the spring 11 can be varied by a movement of the spring fixing block 12 to vary pedal effort of the accelerator pedal. The operation of the motor 13 may be controlled by a controller (not shown) that is includes a processor configured in accordance with a driving condition, a driver condition and driving inclination, etc.

In the accelerator pedal apparatus provided with a pedal effort adjusting module 10 according to the present invention, the pedal effort can be varied actively via program instructions in a processor in the controller in accordance with a driving mode and a parking mode of a vehicle.

Figure 6:
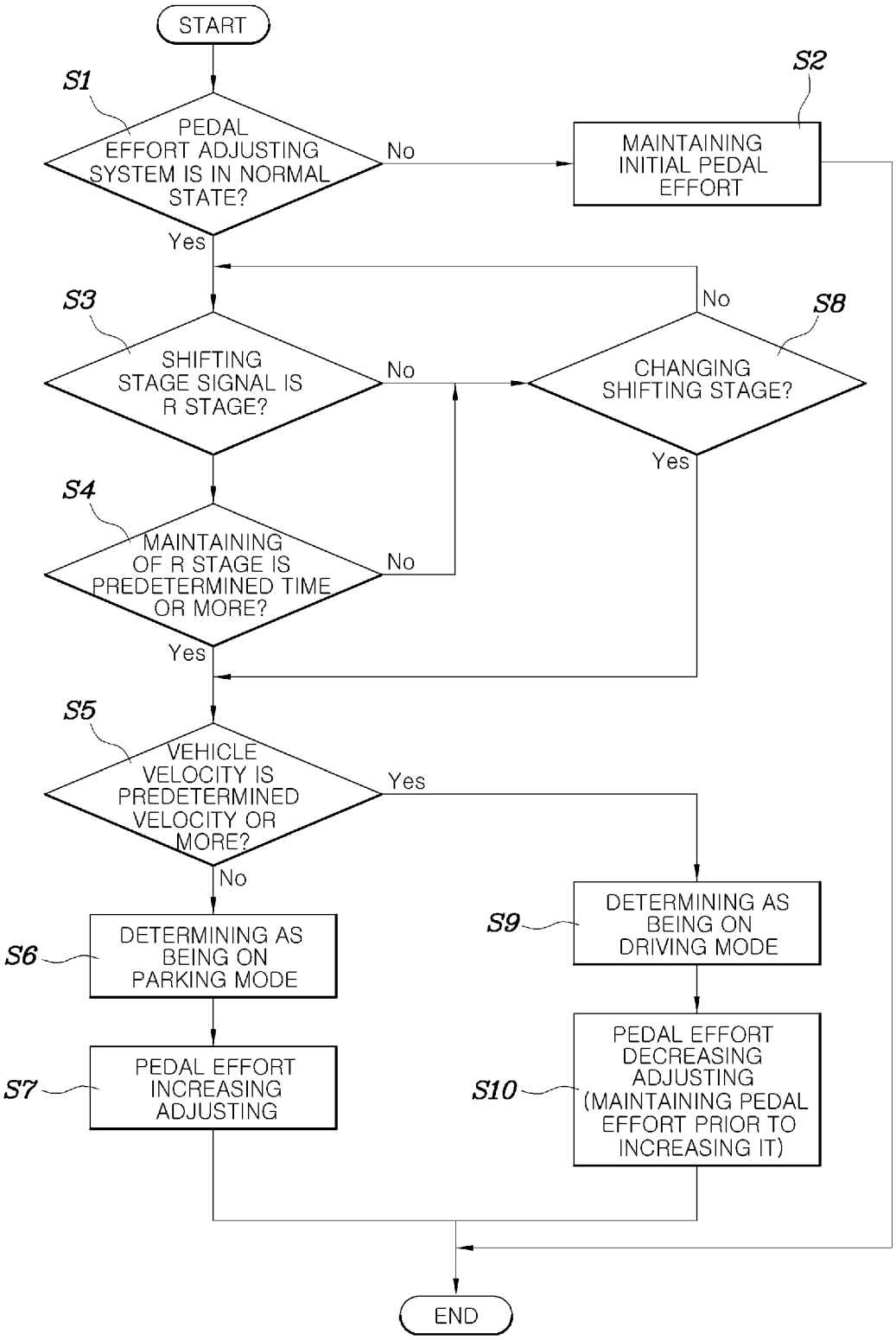
FIG. 6 is a flow chart illustrating a method for adjusting actively the pedal effort, using an accelerator pedal apparatus provided with a pedal effort adjusting function according to the exemplary embodiment of the present invention.

That is, the active control method and system of an accelerator pedal effort according to the present invention may include: as shown in FIG. 6, a system determining step for determining whether a pedal effort adjusting system is in a normal state when a vehicle turns on; a mode determining step that determines whether the vehicle is in a driving mode or a parking mode via a shifting stage input signal and a vehicle velocity after the system determining step; a pedal effort increasing adjusting step that increases a current pedal effort of an accelerator pedal to a preset pedal effort when it is determined that the vehicle is in a parking mode in the mode determining step; and a pedal effort decreasing adjusting step that decreases the current pedal effort to the preset pedal effort when it is determined that the vehicle is in the driving mode in the mode determining step.

The mode determining step may be performed only when the system is in a normal state in the system determining step wherein it may be determined as being in a normal state when all of the conditions are satisfied that a voltage signal of a battery is a normal, there is no request signal for initializing it in accordance with an emergency state and a signal of the pedal effort actively adjusting mode is generated. Furthermore, when the pedal effort adjusting system is in an abnormal state, the current accelerator pedal effort is maintained as being in an initial pedal effort state. Here, the initial pedal effort state refers to a pedal effort reset state.

The mode determining step determines that the vehicle is in a parking mode only when the shifting stage input signal is in a R (reverse) stage, the vehicle is maintained in reverse for a predetermined time (0.5-1.0 sec) or more and the vehicle velocity is a predetermined velocity (15-20 km/h) or less. The mode determining step determines that the vehicle is in a driving mode only when simultaneously the shifting stage input signals are rest shifting stages other than R stage, and the vehicle velocity is a predetermined velocity (15-20 km/h) or more. Furthermore, in the pedal effort decreasing adjusting step, the pedal effort of an accelerator pedal is adjusted to decrease to maintain the pedal effort prior to increasing the pedal effort.

Hereinafter, an operation of the exemplary embodiment of the present invention, an adjusting of the pedal effort will be described. The motor 13 may be operated via program instructions executed by a controller and power from the motor 13 is transmitted to the spring fixing block 12 through the worm gears 15, 17, the worm wheel gears 16, 18, and the gear bolt 19, and then the spring fixing block 12 is raised or lowered along the gear bolt 19 from a state in FIG. 3.

When the spring block 19 is raised along the bear bolt 19 (to a receding direction from the spring plate), the spring 11 is varied by elastic recovery force so that its entire length becomes longer and at this time a spring force applying to the pedal arm 2 is reduced and thus the pedal effort of the accelerator pedal is decreased. On the contrary, when the spring block 19 is lowered along the bear bolt 19 (to an approaching direction to the spring plate), the spring 11 is compressed over an entire length to become shorter and at this time a spring force applying to the pedal arm 2 is increased and thus the pedal effort of the accelerator pedal is increased.

The motor 13 may be operated automatically via program instructions executed by a processor on a controller (not shown). As an example, it may be operated to increase the pedal force on the parking mode thereby preventing a rapid movement of a vehicle and make it possible for the vehicle to be moved minutely and further to decrease the pedal effort on the parking mode thereby reducing the fatigue in accordance with an operation of the accelerator pedal.

Further, the fatigue in accordance with an operation of the accelerator pedal may be reduced by adjusting the pedal effort to be decreased while a vehicle drives at a low velocity (city driving), or the ankle fatigue may be reduced by adjusting the pedal effort to be increased and helping the pedal to be supported constantly while a vehicle drives at a high velocity (express way driving).

Further, the pedal effort may be decreased on an uphill road to increase the amount of pedal operation and increased on a downhill road to decrease the amount of the pedal operation. The pedal effort may be increased for safety while a vehicle drives over predetermined velocity or while in a safety mode, and further the pedal effort may be adjusted properly in considering of age, sex and condition of a driver.

Next, an active control method of varying a pedal effort in accordance with a driving mode and a parking mode of a vehicle will be described.

A controller including the processor may determine whether a pedal effort adjusting system is in a normal state when a vehicle turns on (Step S1). More specifically, it may be determined as being in a normal state when all of the conditions are satisfied so that a voltage signal of a battery is in a normal state, there is no request signal for initializing the signal in accordance with an emergency state and a signal of active adjusting mode of pedal effort is generated.

Here, when the voltage signal of a battery is less than 9V or exceeds to 16.5V, the pedal effort adjusting system may be determined as being in a normal state. The pedal effort of the accelerator pedal is maintained in the initial state (S2) when the pedal effort adjusting system is determined as being in an abnormal state. When the pedal effort adjusting system is determined as being in a normal state, the controller may determine whether the shifting stage input signal is a R (reverse) stage (Step S3). Additionally, when the shifting stage input signal is determined as being on the R stage, the controller may determine whether R stage input signal is maintained for a predetermined time (0.5-1.0 sec) or more (Step S4), and when the R stage is maintain for the predetermined time (0.5-1.0 sec) or more, it may determine whether the vehicle velocity is a predetermined velocity (15-20 km/h) or more (Step S5), and when the vehicle velocity is determined as being the predetermined velocity or more, the controller determines that the vehicle is in the parking mode (Step S6).

When the vehicle is determined as being in the parking mode, the controller may be configured to control the motor 13 for the spring 13 to be compressed so that its length becomes shorter, and at this time the spring force applied to the pedal arm 2 increases to increase the current pedal effort of an accelerator pedal to a preset pedal effort (Step S7).

Meanwhile, in the step S3, when the vehicle is not in reverse (i.e., the shifting stage input signal is not a R stage signal), or in the step S4, when the vehicle is in reverse for a predetermined time (0.5-1.0 sec) or less, the controller determines whether it is a state where the current shifting stage is changed to another shifting stage (whether the vehicles is currently in a different shifting stage) (Step S8). At this time when it is determined that the shifting stage is changing, the method feeds back to a state prior to Step S5, and when it is determined that shifting stage is not changing, method feeds back to a state prior to Step S3.

Furthermore, when it is determined that the shifting stage is changing and at the same time the vehicle velocity is at a predetermined velocity (15-20 km/h) or more, the controller determines that the vehicle is in the driving mode (Step S9). When the vehicle is determined as being in the driving mode, the controller controls the motor 13 for a length of the spring 11 to become longer, and at this time the spring force applied to the pedal arm 2 decreases to adjust downward the current pedal effort of an accelerator pedal to a preset pedal effort (adjust downward to maintain the pedal effort prior to adjusting upward) (Step S10).

According to the accelerator pedal apparatus of the present invention as described above, a length of the spring 11 can be varied by a movement of the spring fixing block 12 in accordance with an operation of the motor 13 without replacing other components separately, and as a result the pedal effort can be varied easily, if necessary, to meet fully the safety regulations with respect to the pedal effort of the accelerator pedal regardless of kinds of vehicles. Further, the pedal effort of an accelerator pedal can be actively varied in accordance with a driving mode and a parking mode of a vehicle thereby greatly improving convenience and safety of a user.

While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

What is claimed is:

1. An active control method of an accelerator pedal effort comprising;

determining, by a controller, whether a vehicle is in a driving mode or a parking mode via shifting stage input signals and a vehicle velocity when the vehicle is turned on;

increasing, by the controller, a current pedal effort of the accelerator pedal to a preset pedal effort when the vehicle is determined as being in the parking mode; and decreasing, by the controller, the current pedal effort of the accelerator pedal to the preset pedal effort when the vehicle is determined as being in the driving mode, wherein determining whether the vehicle is in the driving mode or the parking mode includes determining, by the controller, that the vehicle is in the parking mode only when the shifting stage input signal is a R (reverse) stage, the R stage has been maintained for a predetermined time or more, and the vehicle velocity is a predetermined velocity or less.

2. The active control method of an accelerator pedal effort according to claim 1, further comprising determining whether a pedal effort adjusting system is in a normal state when the vehicle turns on prior to determining whether the vehicle is in the driving mode or the parking mode.

3. The active control method of an accelerator pedal effort according to claim 2, wherein determining whether the vehicle is in the driving mode or the parking mode is performed only when the pedal effort adjusting system is in a normal state, and wherein when the pedal effort adjusting system is in an abnormal state the current pedal effort of the accelerator pedal is maintained as being in an initial pedal effort state.

4. The active control method of an accelerator pedal effort according to claim 3, wherein the pedal effort adjusting system is determined as being in the normal state only when a voltage signal of a battery is less than 9 V or greater than 16.5 V, there is no request signal for initializing in accordance with an emergency state and a signal of active adjusting mode of pedal effort is generated.

5. The active control method of an accelerator pedal effort according to claim 1, further comprising determining that the vehicle is in a driving mode only when simultaneously the shifting stage input signals are rest shifting stages other than the R stage, and the vehicle velocity is a predetermined velocity or more.

6. The active control method of an accelerator pedal effort according to claim 5, further comprising determining that the vehicle is in a driving mode only when the shifting stage input signals are rest shifting stages other than the R stage, and the vehicle velocity is 15-20 km/h or more.

7. The active control method of an accelerator pedal effort according to claim 1, further comprising decreasing the pedal effort to maintain the pedal effort prior to the increasing pedal effort.

8. The active control method of an accelerator pedal effort according to claim 1, further comprising determining that that the vehicle is in the parking mode only when the shifting stage input signal is a R (reverse) stage that is maintained for 0.5-1.0 sec or more and the vehicle velocity is 15-20 km/h or less.

9. A non-transitory computer readable medium containing program instructions executed by a processor or controller, the computer readable medium comprising:

program instructions that determine whether a vehicle is in a driving mode or a parking mode via shifting stage input signals and a vehicle velocity when the vehicle is turned on;

program instructions that determine that the vehicle is in the parking mode only when the shifting stage input signal is a R (reverse) stage, the R stage has been maintained for a predetermined time or more and the vehicle velocity is a predetermined velocity or less;

program instructions that increase a current pedal effort of an accelerator pedal to a preset pedal effort when the vehicle is determined as being in the parking mode; and program instructions that decrease the current pedal effort of the accelerator pedal to the preset pedal effort when the vehicle is determined as being in the driving mode.

10. A controller installed in a vehicle to comprising:

a processor configured to:

determine whether a vehicle is in a driving mode or a parking mode via shifting stage input signals and a vehicle velocity when the vehicle is turned on;

determine that the vehicle is in the parking mode only when the shifting stage input signal is a R (reverse) stage, the R stage has been maintained for a predetermined time or more and the vehicle velocity is a predetermined velocity or less;

increase a current pedal effort of an accelerator pedal to a preset pedal effort when the vehicle is determined as being in the parking mode; and decrease the current pedal effort of the accelerator pedal to the preset pedal effort when the vehicle is determined as being in the driving mode.

* * * * *